US009227131B2

(12) United States Patent
Adamczewski et al.

(10) Patent No.: US 9,227,131 B2
(45) Date of Patent: Jan. 5, 2016

(54) FOUR-PART GLIDING APPARATUS

(71) Applicant: SALOMON S.A.S., Metz-Tessy (FR)

(72) Inventors: David Adamczewski, Annecy (FR); Laurent Picchiottino, Cran-Gevrier (FR); Katy Porter, Charvonnex (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/563,367

(22) Filed: Dec. 8, 2014

(65) Prior Publication Data

US 2015/0157920 A1 Jun. 11, 2015

(30) Foreign Application Priority Data

Dec. 10, 2013 (FR) ..... 13 02888

(51) Int. Cl.
*A63C 5/02* (2006.01)
*A63C 5/03* (2006.01)

(52) U.S. Cl.
CPC . *A63C 5/033* (2013.01); *A63C 5/02* (2013.01); *A63C 5/03* (2013.01); *A63C 5/031* (2013.01); *A63C 2203/06* (2013.01)

(58) Field of Classification Search
CPC ..... A63C 5/02; A63C 5/03; A63C 5/031; A63C 5/033; A63C 5/16; A63C 2203/06
See application file for complete search history.

(56) References Cited

U.S. PATENT DOCUMENTS

| | | | | | |
|---|---|---|---|---|---|
| 2,332,404 | A * | 10/1943 | Smith | ..... | 280/603 |
| 2,367,528 | A * | 1/1945 | Rollins | ..... | 280/603 |
| 3,123,844 | A * | 3/1964 | Bailey | ..... | 441/72 |
| 3,797,838 | A * | 3/1974 | Shurgot | ..... | A63C 5/02 280/603 |
| 4,780,929 | A * | 11/1988 | Burns et al. | ..... | 16/349 |
| 4,844,499 | A * | 7/1989 | Baumann | ..... | A63C 5/02 280/603 |
| 5,458,370 | A * | 10/1995 | Melcher | ..... | 280/817 |
| 5,551,728 | A * | 9/1996 | Barthel et al. | ..... | 280/818 |
| 5,660,416 | A * | 8/1997 | Schiele et al. | ..... | 280/818 |
| 5,984,324 | A | 11/1999 | Wariakois | | |
| 8,733,782 | B2 * | 5/2014 | Smith et al. | ..... | 280/603 |
| 2008/0246236 | A1 * | 10/2008 | Lombano et al. | ..... | 280/18 |
| 2011/0272920 | A1 | 11/2011 | Adamczewski | | |

FOREIGN PATENT DOCUMENTS

| | | |
|---|---|---|
| DE | 89 03 154 U1 | 6/1989 |
| DE | 92 09 879 U1 | 9/1992 |
| DE | 197 03 774 A1 | 8/1998 |
| EP | 0 880 381 B1 | 12/1998 |

OTHER PUBLICATIONS

Machine translation of DE 19703774; Karl; Aug. 6, 1998.*

* cited by examiner

*Primary Examiner* — Katy M Ebner
*Assistant Examiner* — Emma K Frick
(74) *Attorney, Agent, or Firm* — Greenblum & Bernstein, P.L.C.

(57) ABSTRACT

A gliding apparatus includes four gliding bodies that can be selectively separated or assembled together. In the assembled configuration, the first and second gliding bodies form opposite lateral portions of the gliding apparatus, and the third and fourth gliding bodies form a longitudinally extending intermediate gliding body defining a median portion of the gliding apparatus. A device to affix the four gliding bodies together includes first and second assembly elements that are affixed, respectively, to the third and fourth gliding bodies to form the intermediate gliding body. The first assembly element includes at least a first longitudinal projection, projecting from the fourth gliding body and designed to extend over an upper surface of the third gliding body. The first longitudinal projection of the first assembly element is designed to be engaged with the second assembly element to limit relative longitudinal spacing between the third and fourth gliding bodies.

15 Claims, 8 Drawing Sheets

FOUR-PART GLIDING APPARATUS

CROSS-REFERENCE TO RELATED APPLICATION

This application is based upon French Patent Application No. 13/02888, filed Dec. 10, 2013, the disclosure of which is hereby incorporated by reference thereto in its entirety, and the priority of which is claimed under 35 U.S.C. §119.

BACKGROUND

1. Field of the Invention

The invention relates to snow-gliding apparatuses, in particular snowboards comprising a plurality of elements separable into at least two skis.

2. Background Information

Snowboarders often desire practicing their sport in areas that are not accessible to mechanical lifts, particularly in areas of virgin snow or areas less frequented by the public. To this end, a number of snowboarders use touring skis to ascend the slopes to reach a secluded hillside, while carrying a snowboard on their back. Once on the hillside, such snowboarders remove their skis, secure their boots to snowboard and descend the hillside, with the skis fastened on their back.

Due to the need to have a pair of skis and a snowboard, weight and space requirement pose a problem for the user.

To solve this problem, one solution is to join at least two elements side-by-side to form a gliding apparatus. The elements are affixed to one another to achieve a snowboard configuration, or separated to form two independent skis used to ascend the slopes.

European Patent EP 0 880 381-B1 discloses a snowboard comprising two gliding bodies elongated along a longitudinal axis. These gliding bodies form either two independent skis or opposite lateral gliding surfaces of a snowboard. In the snowboard configuration, a rear median gliding body is attached to the two lateral gliding bodies and a front median gliding body is attached to the two lateral gliding bodies. The median gliding bodies form a gliding surface between the lateral gliding bodies.

The front median gliding body is movable in relation to the rear median gliding body when the gliding apparatus is not assembled. These two median gliding bodies are not affixed to one another along a longitudinal direction. Therefore, they do not form a self-retaining intermediate gliding board. They can thus easily be spaced apart.

Consequently, assembly of the snowboard is not easy, as it requires handling at least four independent gliding bodies. This difficulty increases all the more in a snowy environment.

Moreover, the gliding apparatus comprises four connecting bars for affixing the elements to one another, which tends to weigh down and rigidify the gliding apparatus.

Finally, the connection between the two median gliding bodies to one another is uncertain. In the event of a play therebetween or during bending of the board, the interface between the two median gliding bodies may change and create ridges projecting from the lower gliding surface, which can slow down the user when gliding.

SUMMARY

The invention overcomes one or more of the aforementioned disadvantages.

Thus, the invention provides a gliding apparatus which makes it easier to carry median gliding bodies during an ascent.

The invention also enables independent, mutual retention of the median gliding bodies, in particular to facilitate the assembly of the gliding apparatus.

Moreover, the invention further facilitates the assembly of the various gliding bodies.

Further, the invention limits the relative vertical displacement between the lateral gliding bodies and the median gliding bodies.

Still further, the invention provides affixing elements that are easy to manufacture and handle.

Thus, the invention relates to a gliding apparatus comprising first to fourth gliding bodies capable of being selectively affixed to or separated from one another. When the gliding bodies are affixed to one another, the first and second gliding bodies form opposite lateral portions of the assembled gliding apparatus; the third and fourth gliding bodies form an intermediate gliding body defining a median portion of the assembled gliding apparatus. The third and fourth gliding bodies each have a length less than the length of the intermediate gliding body. The intermediate gliding body is arranged between the first and second gliding bodies. The gliding apparatus further includes an affixation device comprising a first assembly element affixed to the fourth gliding body and a second assembly element affixed to the third gliding body and adapted to cooperate with the first assembly element so as to longitudinally affix the third and fourth gliding bodies to one another.

The first assembly element has at least a first longitudinal projection in relation to the fourth gliding body, adapted to cover a portion of an upper face of the third gliding body, the first longitudinal projection being adapted to cooperate with the second assembly element so as to limit the relative spacing between the third and fourth gliding bodies along a longitudinal axis.

This affixation device makes it possible to obtain an autonomous, self-retaining intermediate gliding body, which is thus easier to handle and assemble with the first and second gliding bodies.

According to advantageous but not essential aspects of the invention, a gliding apparatus of this type may incorporate one or more of the following characteristics, taken in any technically acceptable combination:

- The third and fourth gliding bodies can become separated by a relative movement between the two gliding bodies. According to an embodiment, the relative movement between the third and fourth gliding bodies, enabling their separation, comprises a relative transverse translation between these two gliding bodies.
- The second assembly element comprises a screw, the head of which extends radially enough to cover a portion of the first assembly element.
- The first and/or second assembly element comprises a transverse projection in relation to the intermediate gliding body to which it is attached, this projection being adapted to cover a portion of an upper surface of the first or second gliding body.
- The first assembly element comprises a first retaining element cooperating with a first retaining element of the second gliding body so as to limit a relative transverse movement between the second gliding body and the intermediate gliding body when the gliding apparatus is assembled.
- The first assembly element comprises a second retaining element cooperating with a second retaining element of the first gliding body so as to limit a relative transverse movement between the first gliding body and the intermediate gliding body when the gliding apparatus is assembled.

The second assembly element comprises a second retaining element cooperating with a second retaining element of the first gliding body so as to limit a relative transverse movement between the first gliding body and the intermediate gliding body when the gliding apparatus is assembled.

The first and/or second retaining element of an assembly element is a transverse projection in relation to the intermediate gliding body to which it is attached, the projection being adapted to cover a portion of an upper surface of the first or second gliding body; and the first and/or second retaining element of the first or second gliding body is an abutment projecting along the normal to its upper surface. According to an embodiment, the transverse projection is adapted to cooperate with the abutment to limit a relative longitudinal movement between the first or second gliding body and the intermediate gliding body, in at least one direction, when the gliding apparatus is assembled.

The abutment includes a shoulder projecting vertically above the upper surface of the first or second gliding body, this transverse projection being retained between the upper surface of the first or second gliding body and the shoulder to limit a relative movement between the first or second gliding body and the intermediate gliding body along a direction normal to this upper surface.

The first or second body comprises a base of a safety binding adapted to be affixed to a user's boot, this base being fixed to the abutment and positioned above this abutment.

A lock for maintaining the first assembly element and second assembly element in engagement with one another.

The gliding bodies 1, 2, 3, and 4 have keying structure facilitating their affixation to one another to obtain the configuration of a snowboard.

One of the assembly elements is attached to the third or fourth gliding body by screws whose center distance is equal to at least half of the width of this third or fourth gliding body.

BRIEF DESCRIPTION OF DRAWINGS

Other characteristics and advantages of the invention will become apparent from the following description, provided by way of non-limiting example only, with reference to the annexed drawings, in which.

DETAILED DESCRIPTION

The following description makes use of terms such as "horizontal", "vertical", "longitudinal", "transverse", "upper", "lower", "top", "bottom", "front", "rear". These words should be interpreted in relative terms in relation to the normal position of the gliding apparatus, and the normal advance direction thereof. For example, the term "vertical" corresponds to the direction of thickness and "horizontal" to the gliding surface. Similarly, the term "transverse" corresponds to the width of the snowboard and "longitudinal" to its length.

Figure 1:
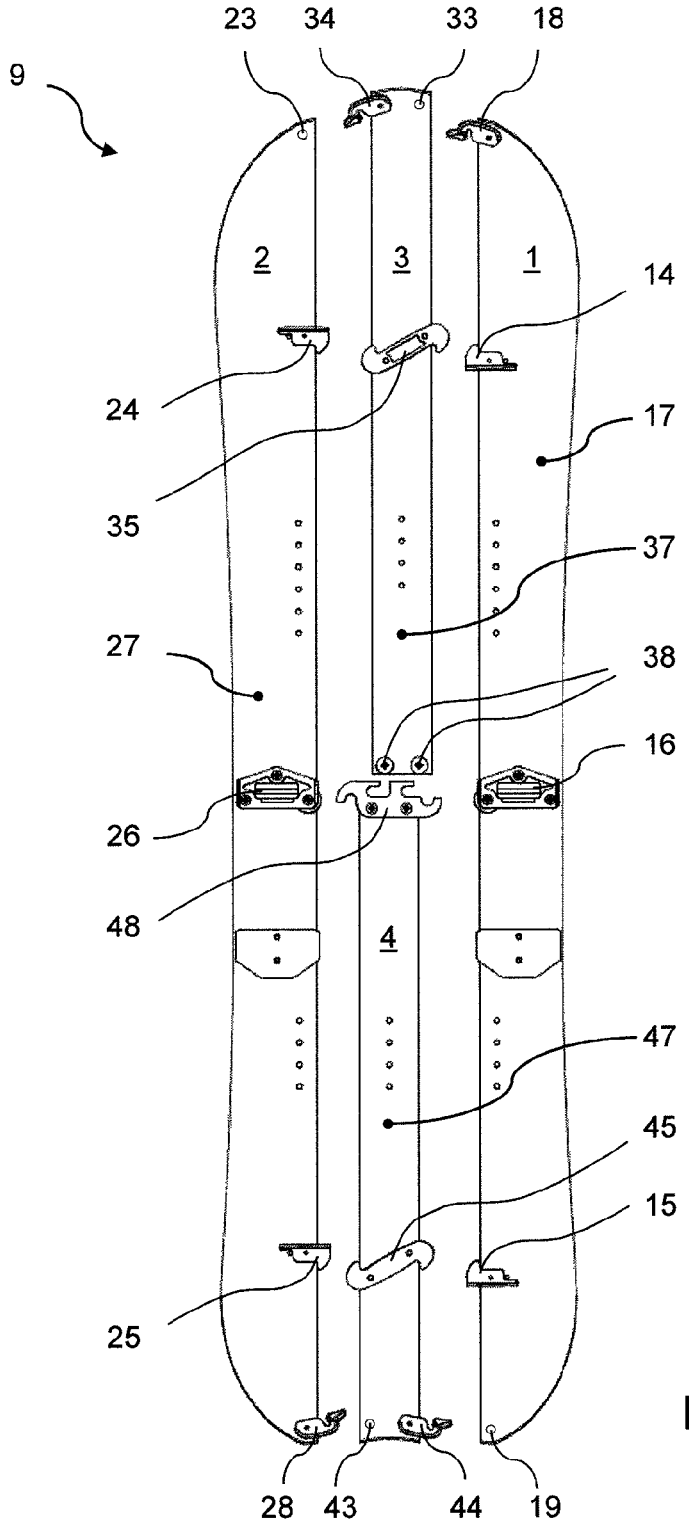
FIG. 1 is a top view of a snow-gliding apparatus according to a first embodiment of the invention, the gliding bodies of which are separated from one another.

FIG. 1 is a top view of a snow-gliding apparatus 9 comprising separated gliding bodies 1, 2, 3, and 4. In the configuration of FIG. 1, the gliding bodies 1 and 2 form independent skis capable of being used, for example, to perform an ascent in ski touring. Each of the gliding bodies 3 and 4 has a length less than that of the gliding bodies 1 and 2. Each of the gliding bodies 3 and 4 has a length less than or equal to 60% of the length of the gliding body 1 in the illustrated exemplary embodiment. In this configuration, the gliding bodies 3 and 4 can be superimposed in order to be easily transported with reduced space requirement by the user, for example in a backpack, during ski touring.

Figure 2:
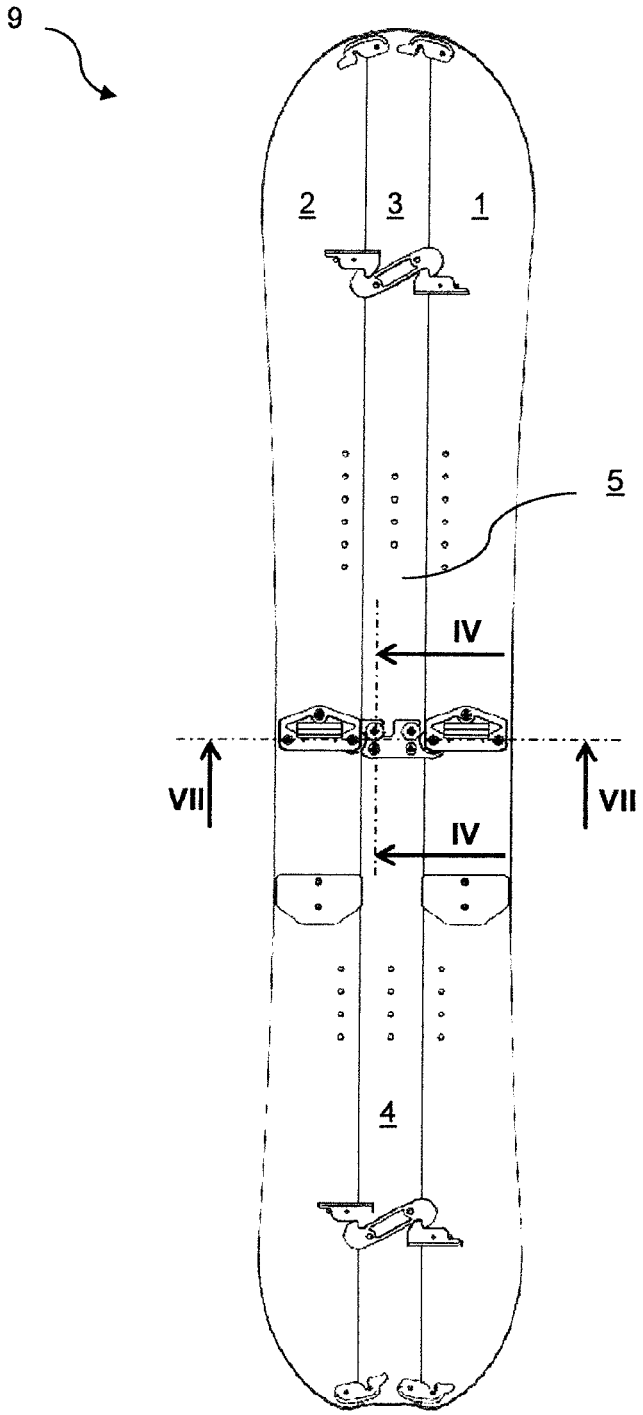
FIG. 2 is a top view of the snow-gliding apparatus of FIG. 1, the gliding bodies of which are affixed to one another.

FIG. 2 is a top view of the gliding apparatus 9, in which the gliding bodies 1, 2, 3, and 4 are connected to one another to form a snowboard. The gliding bodies 1 and 2 then form opposite lateral portions of the snowboard. The gliding bodies 3 and 4 are longitudinally affixed to one another to form an intermediate gliding body 5 defining the median portion of the gliding surface. The intermediate body 5, comprised of the gliding bodies 3 and 4, is then arranged between the gliding bodies 1 and 2. Each gliding body 3 and 4 has a length less than the length of the intermediate gliding body 5. Each gliding body 1, 2, 3, and 4 has an elongated shape and extends, in this configuration, along an axis parallel to the longitudinal axis of the gliding apparatus 9.

The gliding bodies 1, 2, 3, and 4 may selectively be affixed to one another to obtain the configuration of FIG. 2, or separated to obtain the configuration of FIG. 1.

In this example, each gliding body includes a lower surface forming a gliding surface designed to be in contact with the snow.

An affixation device selectively makes it possible to longitudinally affix the gliding bodies 3 and 4 directly to one another. Thus, the median portion of the gliding surface can be maintained in one piece prior to being affixed to the gliding bodies 1 and 2. This facilitates the assembly of the gliding apparatus because, in this case, there are only three gliding bodies to be affixed to one another.

Furthermore, this longitudinal affixation of the gliding bodies 3 and 4 limits the deformation of the gliding apparatus 9 during use thereof as a snowboard, especially when the apparatus flexes.

In the first embodiment illustrated in FIGS. 1 and 2, the affixation device comprises a first assembly element 48 fixed against an upper surface 47 of the gliding body 4, and a second assembly element 38 fixed against an upper surface 37 of the gliding body 3. In this example, the second assembly element 38 corresponds to two assembly screws screwed into the upper surface 37 of the gliding body 3. The assembly elements 38 and 48 of this embodiment are more specifically illustrated in FIGS. 3 and 4.

In this example, the first assembly element 48 has two longitudinal projections 487A, 487B in relation to the gliding body 4, that is to say that a portion of the assembly element 48 extends beyond a longitudinal edge 41 of the gliding body 4. These longitudinal projections 487A, 487B are designed to cover a portion of the upper surface 37 of the gliding body 3. Thus, a relative vertical displacement (that is to say along the normal to the upper surfaces 37 and 47) is limited, in a first direction, between the gliding bodies 3 and 4 when the gliding apparatus is assembled.

In the illustrated embodiment, the longitudinal projections 487A, 487B are designed to cooperate with the assembly screws 38 so as to limit the relative spacing between the gliding bodies 3 and 4 along the longitudinal axis, when the gliding bodies 3 and 4 are assembled. The assembly element 48 thus has a plurality of functions (vertical and longitudinal retention).

In the first illustrated embodiment, the first assembly element 48 includes a substantially flat plate 481. The plate 481 has a portion 489 in contact with the upper surface 47 of the gliding body 4, and is arranged above the upper surface 47. The plate 481 is fixed onto the gliding body 4 by two screws 486 positioned in the portion 489 of the plate 481. In this example, the screws 486 are aligned along an axis transverse to the gliding body 4. The center distance between the screws 486 is equal to at least half of the width of the gliding body 4 so as to limit the bending deformation of the assembly element 48 about an axis longitudinal to the gliding apparatus. The plate 481 also has the longitudinal projections 487A, 487B each forming an extension of the plate 481 which extends longitudinally beyond the longitudinal edge 41 of the gliding body 4. In this embodiment, each longitudinal projection 487A, 487B forms a hook designed to cooperate with an interface portion 382 of an assembly screw 38, when the intermediate gliding body 5 is assembled. The hooks and assembly screws are arranged so as to limit the relative spacing between the gliding bodies 3 and 4 when the hooks 487A, 487B cooperate with the assembly screws 38.

Figure 4:
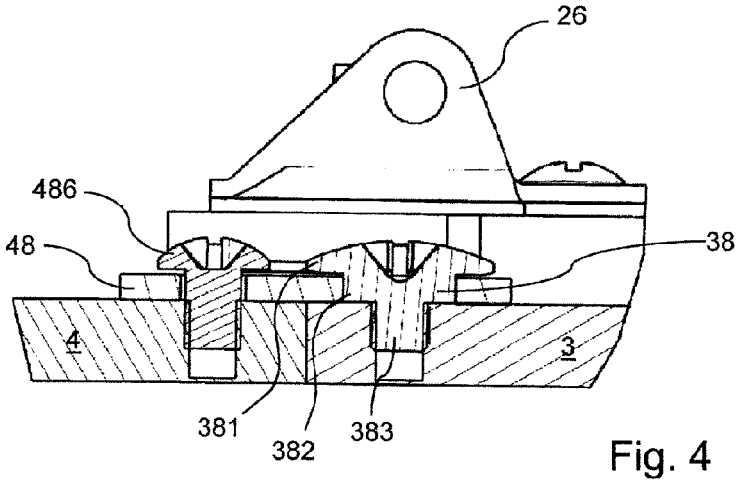
FIG. 4 is a partial cross-sectional view along the line IV-IV of FIG. 2.

Furthermore, the second assembly element is formed, in this example, by two assembly screws 38. These screws 38 are aligned along an axis transverse to the gliding body 3. The center distance between the screws 38 is equal to at least half of the width of the gliding body 3. As shown in FIG. 4, each assembly screw 38 includes three successive longitudinal portions, namely, a screw head 381, an interface portion 382, and a threaded portion 383. The interface portion 382 is therefore located between the screw head 381 and the threaded portion 383. The interface portion 382 may be in the form of a cylinder having circular cross section or any cross section. It can also take the form of a parallelepiped. The height of the interface portion is substantially equal to the thickness of the plate 481. The threaded portion 383 is engaged with a corresponding threaded hole, opening out onto the upper surface 37 of the gliding body 3. Preferably, the entire threaded portion is engaged in the gliding body 3 so that only the interface portion 382 and the screw head 381 project from the upper surface 37 of the gliding body 3. The screw head 381 extends radially in relation to the axis of the screw, sufficiently to cover a portion of the plate 481 when the hooks 487A, 487B cooperate with the assembly screws 38. Thus, when the intermediate gliding body 5 is formed, this covering makes it possible to sandwich the plate 481 between the screw head 381 and the upper surface 37 of the gliding body 3. This overlapping limits a relative vertical displacement, in a second direction, between the gliding bodies 3 and 4 when the gliding apparatus is assembled.

Due to the screw heads 381 and longitudinal projections 487A, 487B, the respective gliding surfaces of the gliding bodies 3 and 4 can be retained without relative vertical displacement. This makes it possible, for example, to keep their gliding surfaces flush. The discontinuities of the median portion of the gliding surface formed by the gliding surfaces of the gliding bodies are thus limited.

Figure 3:
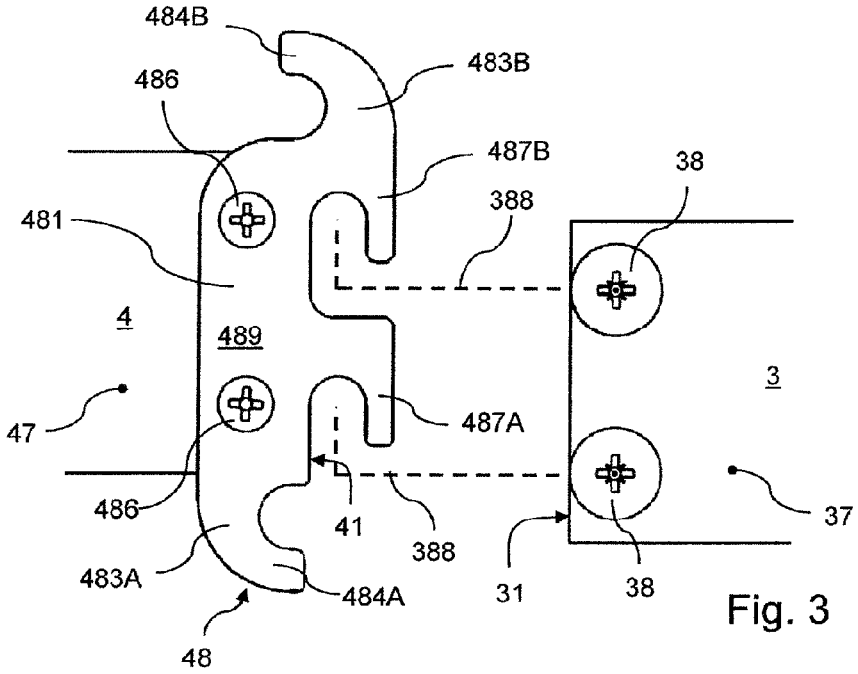
FIG. 3 is a top view of assembly elements according to the first embodiment, mutually cooperating and being part of two median gliding bodies.

As shown in FIG. 3, the plate 481 and more particularly the longitudinal projections 487A, 487B demarcate cutouts forming a guiding path 388 for each interface portion 382 of the screws 38. Thus, the assembly of the gliding bodies 3 and 4 to form the intermediate gliding body 5 is such that each interface portion 382 of the screws 38 follows the corresponding guiding path 388 defined by a cutout in the plate 481. In this example, each guiding path 388 forms an "L", or substantially forms an "L", defined by a hook 487A, 487B. In this example, the longitudinal affixation of the two gliding bodies is therefore achieved by a "bayonet"-type assembly. In a first step, the gliding bodies 3 and 4 are brought sufficiently close together so as to position the longitudinal edges 31, 41 against one another, the two gliding bodies 3 and 4 being misaligned, or offset, so that the assembly screws 38 do not interfere with the longitudinal projections 487A, 487B when the gliding bodies are brought together. Then, the sliding body 3 is translated laterally with respect to the other gliding body 4 to substantially align both along the same longitudinal axis. This configuration is achieved when the assembly screws 38 abut against the hooks 487A, 487B. The intermediate gliding body 5 is then assembled. The intermediate gliding body 5 has a self-retention ability that makes it easy to handle. The two gliding bodies 3 and 4 are affixed to one another longitudinally, vertically, and along a transverse direction. The two gliding bodies are thereby properly retained independently due to the assembly elements 38 and 48. This assembly also provides good continuity between the gliding surface of the gliding body 3 and that of the gliding body 4.

In an alternative embodiment, a lock can be provided for blocking the still free transverse displacement. The lock may be removable. It can be connected to a gliding body. The lock makes it possible to maintain the first assembly element 48 and second assembly element 38 in engagement with one another. For example, it may be a retractable pin, a clip, a screw, a pin closing off at least one guiding path 388.

The first embodiment encompasses a first assembly element 48 with two longitudinal projections 487A, 487B cooperating with two assembly screws 38. This allows having a stable, robust, and easy-to-assemble construction. The bending strength of the assembly is also improved about a longitudinal axis of the gliding apparatus. Alternatively, the first assembly element 48 may comprise only one longitudinal projection 487A, 487B cooperating with a single assembly screw 38. Similarly, the first assembly element 48 may include more than two longitudinal projections 487A, 487B cooperating with as many assembly screws 38.

According to this first embodiment, the assembly element 48 has an additional function, namely, that of longitudinally positioning and transversely retaining the assembled gliding bodies 3 and 4 with respect to the gliding bodies 1 and 2, respectively. In this example, the assembly element 48 also comprises two retaining elements in the form of two transverse projections 483A, 483B. Each transverse projection 483A, 483B forms an extension of the plate 481 and extends laterally beyond one side of the gliding body 3. A first transverse projection 483A forms a positioning and retaining element designed to cover a portion of the upper surface 17 of the gliding body 1 in the configuration of FIG. 2. The transverse projection 483A thus makes it possible to limit a relative vertical movement between the body 4 and the body 1. The transverse projection 483A forms a hook 484A in this example. A second transverse projection 483B forms a positioning and retaining element designed to cover a portion of the upper surface 27 of the gliding body 2 in the configuration of FIG. 2. The transverse projection 483B makes it possible to limit a relative vertical movement between the body 4 and the body 2. The transverse projection 483B forms a hook 484B in this example. The hooks 484A and 484B define openings having opposite or, in other words, symmetrical orientations with respect to a vertical axis.

Figure 5:
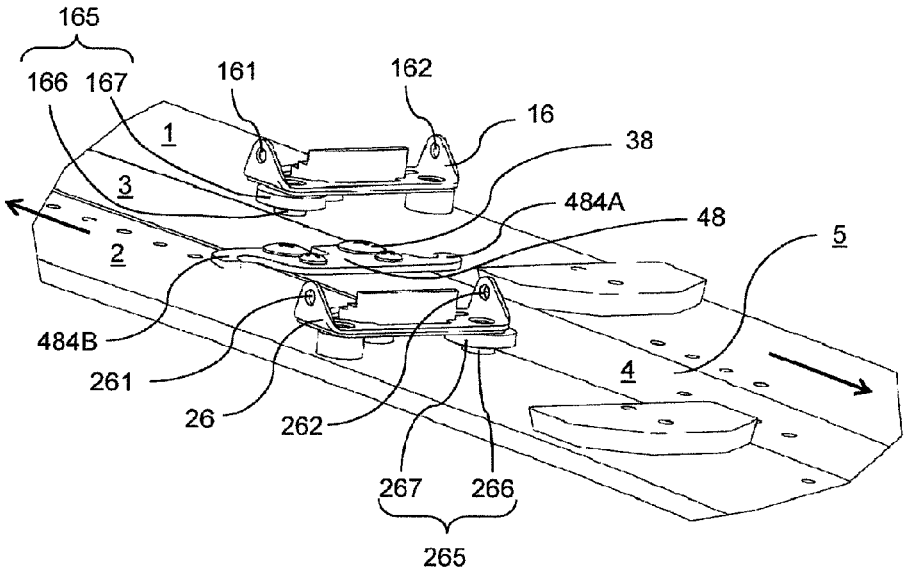
FIG. 5 is a perspective detailed view of a gliding apparatus according to the first embodiment, during an intermediate step of affixing its gliding bodies.
Figure 6:
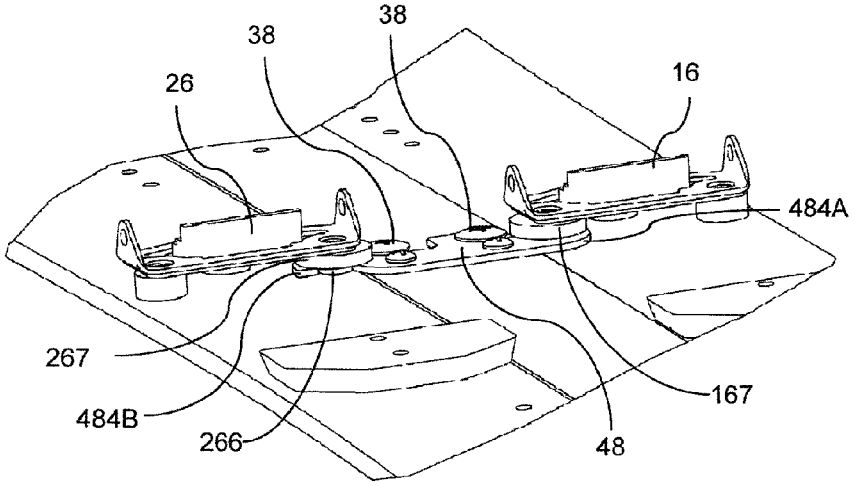
FIG. 6 is a perspective view of the gliding apparatus of FIG. 5, the gliding bodies of which are affixed to one another.
Figure 7:
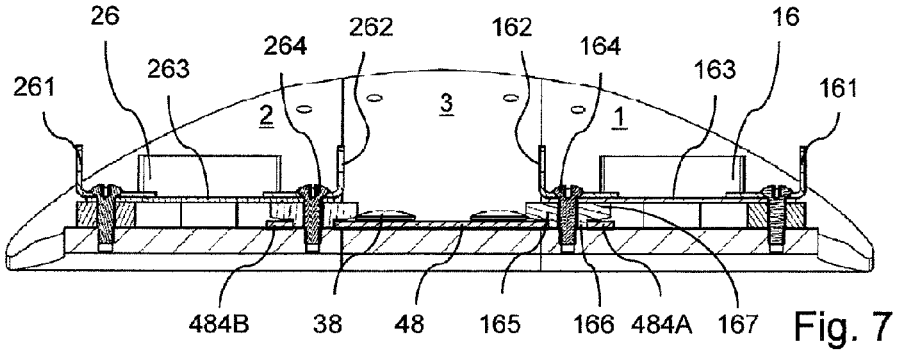
FIG. 7 is a cross-sectional view along the line VII-VII of FIG. 2.

FIGS. 5 and 6 are perspective views of the gliding apparatus 9, during the connecting of the intermediate gliding body 5 to the gliding bodies 1 and 2, and subsequent to such connecting, respectively. FIG. 7 is a cross-sectional view of the gliding apparatus 9.

The gliding body 1 comprises a retaining element in the form of an abutment 165 projecting along the normal to its upper surface 17. In this example, the abutment 165 forms a two-step cylinder. The lower portion 166, the closer to the upper surface 17, cooperates with the transverse projection 483A to limit a longitudinal sliding movement between the gliding bodies 1 and 4, at least along one direction. In practice, the hook 484A partially surrounds the lower portion 166, further forming a transverse restraint of the movements of the abutment 165. The transverse spacing between the gliding bodies 1 and 4 is therefore limited. The abutment 165 also includes an upper portion 167 having a diameter greater than the lower portion 166. The shoulder thus formed by this upper portion ensures a vertical retention of the vertical hook 484A. The transverse projection 483A is then retained between the upper surface 17 of the body 1 and the shoulder 167 to limit a relative movement between the bodies 1 and 4 along a direction normal to the upper surface.

Similarly, the gliding body 2 comprises a retaining member in the form of an abutment 265 projecting along the normal to its upper surface 27. The abutment 265 forms a two-step cylinder. The lower portion 266, the closer to the upper surface 27, cooperates with the transverse projection 483B to limit a longitudinal sliding movement between the gliding bodies 2 and 4, at least in one direction. In practice, the hook 484B partially surrounds the lower portion 266, further forming a transverse restraint of the movements of the abutment 265. The transverse spacing between the gliding bodies 2 and 4 is therefore limited. The abutment 265 also includes an upper portion 267 having a diameter greater than the lower portion 266. The shoulder thus formed by this upper portion ensures vertical retention of the hook 484B. The transverse projection 483B is then retained between the upper surface 27 of the body 2 and the shoulder 267 to limit a relative movement between the bodies 2 and 4 in a direction normal to the upper surface.

The assembly element 48 is then additionally used for limiting movements between components of the gliding apparatus 9.

That which relates to the gliding body 4 also relates de facto to the intermediate gliding body 5, because the latter is comprised of the combined gliding bodies 3 and 4. Thus, the intermediate gliding body 5 is affixed to the gliding bodies 1 and 2, mutatis mutandis, by the structures and relationships described above.

The affixation of the intermediate gliding body 5 to the gliding bodies 1 and 2 is then achieved by relative longitudinal sliding movements. In a first step, a lateral edge, i.e., lateral side surface, of the gliding body 1 is positioned against a lateral edge, or lateral side surface, of the intermediate gliding body 5 with an offset so that the transverse projection 483A and the abutment 165 do not hinder bringing closer together the gliding bodies 1 and 5. Then, the gliding body 1 is longitudinally translated in relation to the intermediate gliding body 5 until the hook 484A abuts against the abutment 165. In this configuration, the hook 484A cooperates with the abutment 165 to retain the assembly transversely, vertically, and along a longitudinal direction. The relative vertical and transverse movement between the first gliding body and the intermediate gliding body is thus limited. A similar operation is performed between the gliding body 2 and the assembled intermediate gliding body 5 and gliding body 1 assembly. A lateral edge, i.e., lateral side surface, of the gliding body 2 is positioned against the free lateral edge, or lateral side surface, of the intermediate gliding body 5 with an offset so that the transverse projection 483B and the abutment 265 do not hinder bringing coming closer together the gliding body 2 and the assembled intermediate gliding body 5 and gliding body 1 assembly. Then, the gliding body 2 is longitudinally translated in relation to the intermediate gliding body 5 until the hook 484B abuts against the abutment 265. In this configuration, the hook 484B cooperates with the abutment 265 to retain the assembly transversely, vertically, and along a longitudinal direction. The relative vertical and transverse movement between the second gliding body and the intermediate gliding body is thus limited.

The cooperation of the hooks 484A and 484B with the abutments 165, 265 makes it possible to affix the gliding bodies 1, 2 and 4 transversely. Because the gliding body 3 is transversely arranged between the gliding bodies 1 and 2, the body 3 cannot move transversely. Consequently, when the gliding apparatus 9 is assembled, the relative transverse movement between the gliding body 3 and the gliding body 4 is limited. Therefore, the cooperation of the hooks 484A and 484B with the abutments 165, 265 makes it possible to lock the affixation device of the gliding bodies 3 and 4.

Thus, the affixation device comprising the assembly elements 38 and 48 ensures the assembly of the gliding bodies 3 and 4 to form the intermediate gliding body 5. This assembly is not locked and can be separated by a transverse movement followed or not followed by a longitudinal movement. However, this assembly device is designed, in this example, so that when the gliding bodies 1 and 2 are affixed to the intermediate gliding body 5, it locks the affixation device of the gliding bodies 3 and 4. The gliding bodies 3 and 4 can no longer become separated as there is no longer a relative transverse movement between the gliding bodies 3 and 4. Advantageously, at least one element of the affixation device of the gliding bodies 3 and 4 also contributes to the affixation of one of the gliding bodies 1 and 2 to the intermediate gliding body 5. In a particular embodiment, a single element of the affixation device of the gliding bodies 3 and 4 also contributes to the affixation of the two gliding bodies 1 and 2 to the intermediate gliding body 5. In this case, it is the assembly element 48.

In the illustrated embodiment, the abutments 165 and 265 are integrated into supports for bases of safety bindings designed to be affixed to the user's boots. Such integration makes it possible to reduce the number of mechanical components of the gliding apparatus 9.

The gliding body 1 thus comprises a base 16 for fixing a boot-retaining device for ascending a slope. In this example, this base 16 includes a stirrup comprising a plate 163 and two flanges 161 connected by the plate 163. Bores 162 are provided in the flanges 161. The plate 163 is fixed to the gliding body 1 by means of screws 164. A screw 164 extends through the abutment 165. The abutment 165 here forms a spacer between the plate 163 and the surface 17 of the gliding body 1.

This spacer, i.e., the abutment 165, makes it possible to position the retaining device at a sufficient distance from the gliding surface of the gliding body 1, so that the retaining device does not come into contact with the snow on slopes. In this case, the snowboarder is on a slope. The ski is laterally inclined in relation to the normal to the slope. In this configuration, the retaining device should not touch the snow to avoid slowing the progress of the snowboarder. This need is all the more pronounced as a wide retaining device is used. However, the same retaining device is used for the touring ski configuration and snowboard configuration. This retaining device is generally relatively wide to be compatible with flexible boots. Therefore, to avoid friction with the snow, it is necessary to move the retaining device sufficiently away from the gliding surface.

The abutment 165 thus has several functions (retention of the assembly, longitudinal positioning of the elements with respect to one another, elevation). Its integration into the spacer of the base optimizes the gliding apparatus. The binding is compact and contributes to the strength of the assembly of the gliding bodies.

Similarly, the gliding body 2 comprises a base 26 for fixing a boot-retaining device designed for ascending a slope. In this example, this base 26 comprises a stirrup including a plate 263 and two flanges 261 connected by the plate 263. Bores 262 are provided in the flanges 261. The plate 263 is fixed to the gliding body 2 by means of screws 264. A screw 264 extends through the abutment 265. The abutment 265 here forms a spacer between the plate 263 and the surface 27 of the gliding body 2.

The gliding bodies 1, 2, 3, 4 are configured to receive and position safety bindings for the practice of snowboarding.

To retain the assembled gliding apparatus 9, other structures to limit relative movements between the bodies 3, 4 and the bodies 1, 2 can also be provided in order to limit these relative movements at one or several other points along the longitudinal axis of the gliding apparatus 9.

Figure 8:
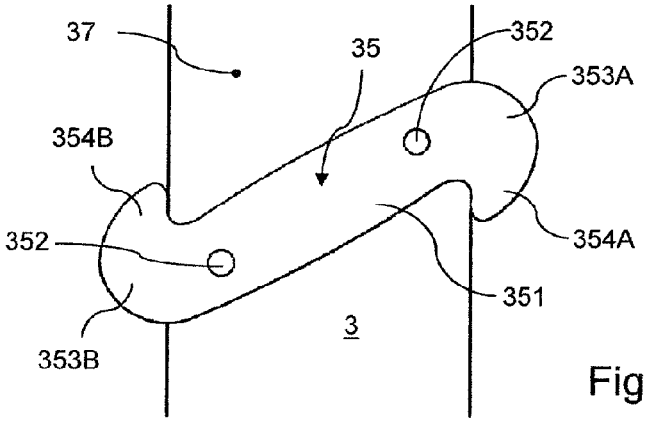
FIG. 8 is a top view of an example of an assembly element designed to affix a median gliding body to two lateral gliding bodies.

For example, in the illustrated embodiment, the gliding body 3 comprises an assembly element 35 longitudinally spaced from the assembly screws 38. The assembly element 35 is illustrated in top view in FIG. 8. The assembly element 35 is fixed against the upper surface 37 of the gliding body 3. It is designed to cooperate with assembly elements 14 and 24 attached to the gliding bodies 1 and 2, respectively.

In the illustrated embodiment, the assembly element 35 includes a substantially flat plate 351. The plate 351 has a portion in contact with the upper surface 37 of the gliding body 3 and it is arranged above this upper surface 37. The plate 351 is fixed to the gliding body 3 by two screws housed in two bores 352 extending through the plate.

The assembly element 35 comprises a first transverse projection 353A extending beyond the gliding body 3 in the direction of the gliding body 1. This projection 353A forms an extension of the plate 351. It forms a positioning element designed to cover a portion of the upper surface 17 of the gliding body 1 in the configuration of FIG. 2. The projection 353A thus makes it possible to limit the relative vertical movements between the body 3 and the body 1. The projection 353A forms a hook 354A in this example.

The assembly element 35 also comprises a second transverse projection 353B extending beyond the gliding body 3 in the direction of the gliding body 2. This projection 353B forms an extension of the plate 351. It forms a positioning element designed to cover a portion of the upper surface 27 of the gliding body 2 in the configuration of FIG. 2. The projection 353B thus makes it possible to limit the relative vertical movements between the body 3 and the body 2. The projection 353B forms a hook 354B in this example.

The hooks 354A and 354B enable the gliding body 3 to become affixed along the longitudinal axis to gliding bodies 1 and 2, respectively. The hooks 354A and 354B cooperate with assembly elements 14 and 24, respectively. The assembly elements 14 and 24 are attached to the gliding bodies 1 and 2, respectively. The hooks 354A and 354B define openings having opposite or, in other words, symmetrical orientations with respect to a vertical axis.

Figure 9:
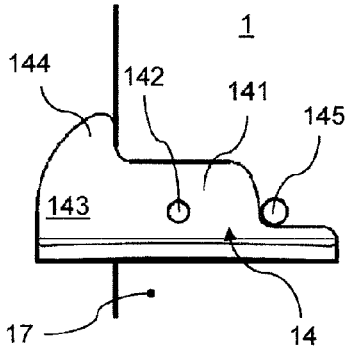
FIG. 9 is a top view of an example of assembly element designed to affix a lateral gliding body to a median gliding body.
Figure 10:
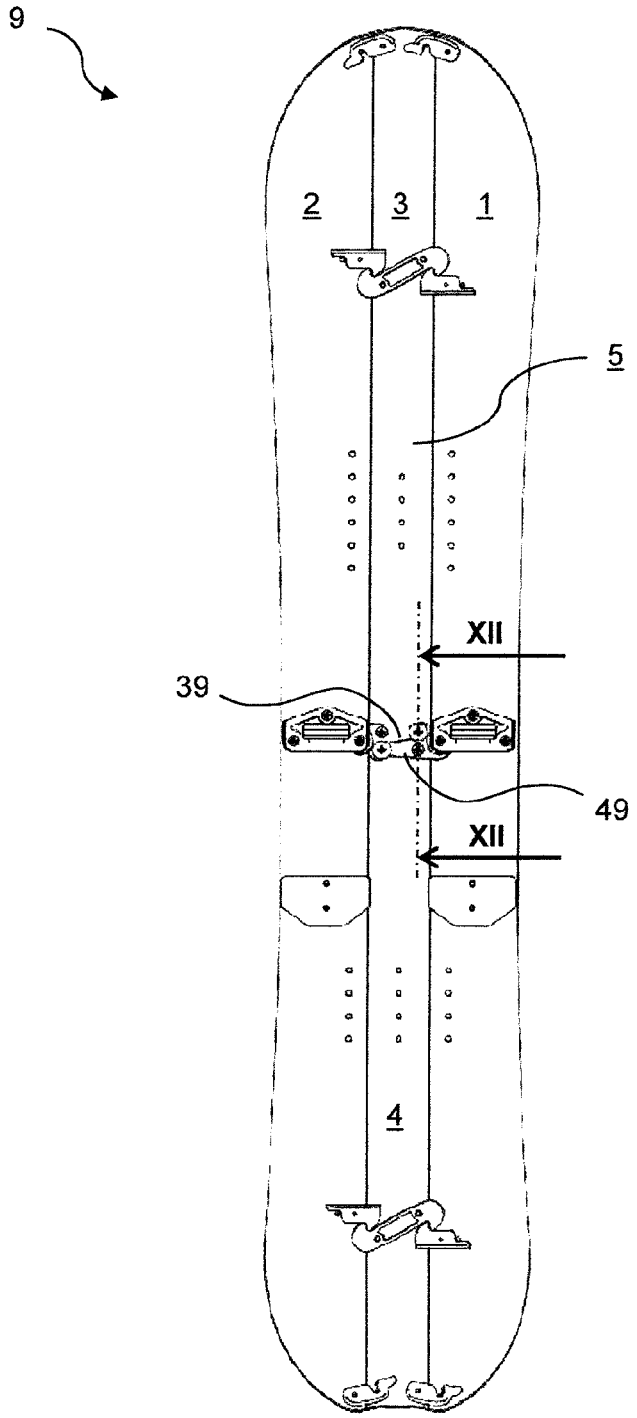
FIG. 10 is a top view of a snow-gliding apparatus according to a second embodiment of the invention, the gliding bodies of which are affixed to one another.
Figure 11:
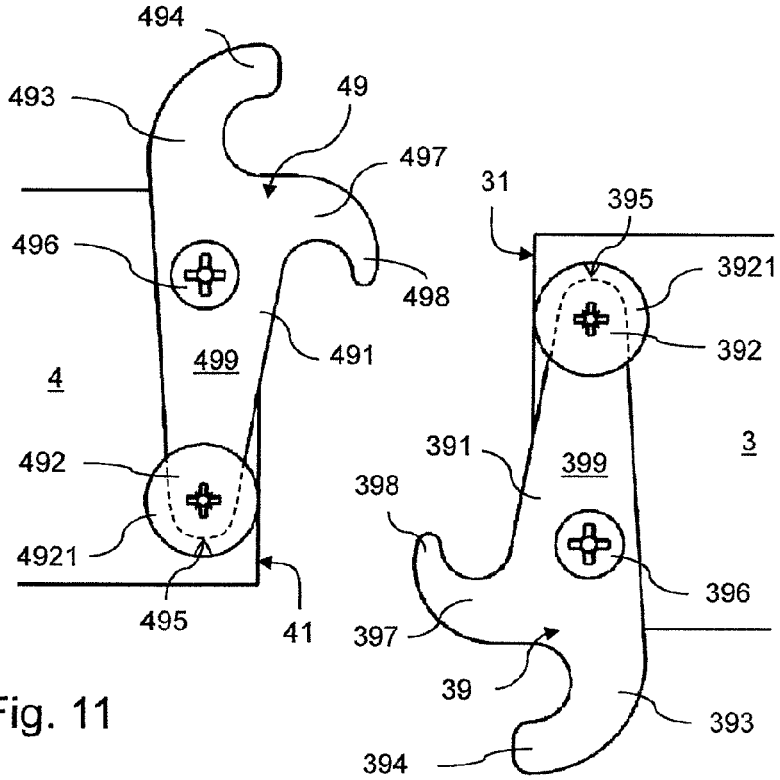
FIG. 11 is a top view of assembly elements according to the second embodiment, mutually cooperating and being part of two median gliding bodies.
Figure 12:
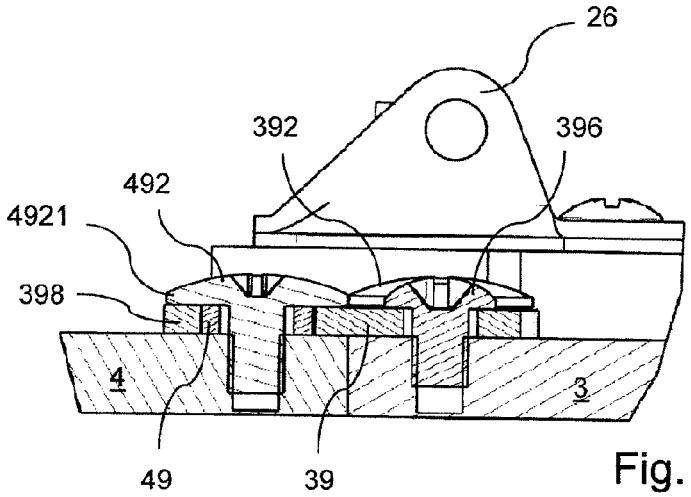
FIG. 12 is a cross-sectional view along the line XII-XII of FIG. 10.

An example of the assembly element 14 is illustrated in top view in FIG. 9. The assembly element 14 includes a substantially flat plate 141. The plate 141 has a portion in contact with the upper surface 17 of the gliding body 1, and arranged above this upper surface 17. The assembly element 14 comprises a transverse projection 143 extending beyond the gliding apparatus 1. The transverse projection 143 forms an extension of the plate 141. The projection 143 forms a positioning element designed to cover a portion of the upper surface 37 of the gliding body 3 in the configuration of FIG. 2. The projection 143 thus makes it possible to limit the relative vertical movements between the body 1 and the body 3. The projection 143 forms a hook 144 in this example. The hook 144 is configured to engage the hook 354A in the configuration of FIG. 2. This cooperation ensures a transverse retention between the two gliding bodies. A bore 142 is provided in the plate 141 for passage of the shaft of a screw for attachment to the gliding body 1. A screw shaft 145 is positioned adjacent the assembly element 14 and fixed in the gliding body 1. This screw shaft 145 is used to block one rotational direction of the assembly element 14 when the projection 143 transversely extends beyond the gliding body 1. Conversely, this screw shaft 145 enables rotation of the assembly element 14 in an opposite rotational direction about the axis of the bore 142 to bring the projection 143 above the gliding body 1 for the practice of ski touring.

The assembly element 24 is identical to the assembly element 14 but is mounted in a configuration at 180° with respect to the assembly element 14, so that the hooks 144 define openings having opposite orientations when they are in engagement with the assembly element 14.

Similarly, the gliding body 4 also comprises an assembly element 45 longitudinally spaced from the assembly element 48. The assembly element 45 is designed to cooperate with assembly elements 15 and 25 attached to the gliding bodies 1 and 2, respectively. The assembly element 45 is in this case identical to the assembly element 35 and, therefore, is not further detailed. The same is true for the assembly elements 15 and 25 with reference to the assembly elements 14 and 24.

In the illustrated example, the assembly element 35 is formed in one piece, which makes it possible to reinforce the assembly of the gliding body 3 to the gliding bodies 1 and 2 and decreases the number of constituent elements of the gliding apparatus 9. In an alternative version, this assembly element can be divided into two separate assembly elements.

To further facilitate the affixing of the gliding bodies 1, 2, 3, 4 to the ends of the gliding apparatus 9 in the configuration of FIG. 1:

- the gliding body 1 comprises a hook 18 in the area of its front end and a pin 19 in the area of its rear end;
- the gliding body 3 comprises a hook 34 and a pin 33 in the area of its front end;
- the gliding body 4 comprises a hook 44 and a pin 43 in the area of its rear end;
- the gliding body 2 comprises a pin 23 in the area of its front end and a hook 28 in the area of its rear end.

In the configuration of FIG. 2:

- the hook 18 is affixed to the pin 33;
- the hook 34 is affixed to the pin 23;
- the hook 44 is affixed to the pin 19;
- the hook 28 is affixed to the pin 43.

Each of the pins 19, 23, 33, 43, or studs, can take the form of a small cylindrical projection, for example, or other shape, which is engageable with a respective one of the hooks.

FIGS. 10-13 illustrate a second embodiment of the invention.

In this embodiment, the first assembly element 48 is replaced with a first assembly element 49, and the second assembly element 38, namely, the two screws, is replaced with a second assembly element 39. The two assembly elements 39 and 49 are identical and opposingly mounted, which is more economical.

The first assembly element 49 is fixed against an upper surface 47 of the gliding body 4, and the second assembly element 39 is attached against an upper surface 37 of the gliding body 3.

The first assembly element 49 has a longitudinal projection 497 with respect to the gliding body 4, that is to say, a portion of the assembly element extends beyond the longitudinal edge 41 of the gliding body 4. This longitudinal projection 497 is designed to cover a portion of the upper surface 37 of the gliding body 3. Thus, a relative vertical displacement (that is to say along the normal to the upper surfaces 37 and 47) is limited, in a first direction, between the gliding bodies 3 and 4 when the gliding apparatus is assembled.

In this embodiment, the longitudinal projection 497 is designed to cooperate with the assembly element 39 so as to limit the relative spacing between the gliding bodies 3 and 4 along the longitudinal axis, when the gliding bodies 3 and 4 are affixed. The assembly element 49 thus assumes a plurality of functions.

The first assembly element 39 has a longitudinal projection 397 with respect to the gliding body 3, that is to say, a portion of the assembly element extends beyond the longitudinal edge 31, or end surface, of the gliding body 3. This longitudinal projection 397 is designed to cover a portion of the upper surface 47 of the gliding body 4. Thus, a relative vertical displacement is limited, in a second direction, between the gliding bodies 3 and 4 when the gliding apparatus is assembled.

Due to these two longitudinal projections 397, 497, the respective gliding surfaces of the gliding bodies 3 and 4 can be retained without relative vertical displacement. This makes it possible, for example, to keep their gliding surfaces flush. The discontinuities of the median portion of the gliding surface formed by the gliding surfaces of the gliding bodies are thus limited.

In the illustrated embodiment, the assembly element 39 includes a substantially flat plate 391. The plate 391 has a portion 399 in contact with the upper surface 37 of the gliding body 3, and arranged above this upper surface 37. The longitudinal projection 397 forms an extension of the plate 391 extending longitudinally beyond the longitudinal edge 31, or end surface, of the gliding body 3. In this embodiment, the longitudinal projection 397 forms a hook 398 designed to cooperate with an end 495 of the assembly element 49 when the intermediate gliding body 5 is assembled. The hook and the end of the assembly element are arranged so as to limit the relative longitudinal spacing between the gliding bodies 3 and 4 when the hook 398 cooperates with the assembly element 49.

In this example, the assembly element 39 also comprises a transverse projection 393. It forms an extension of the plate 391 and extends laterally beyond one side of the gliding body 3. The transverse projection 393 forms a positioning element designed to cover a portion of the upper surface 17 of the gliding body 1 in the configuration of FIG. 2. The transverse projection 393 thus makes it possible to limit a relative vertical movement between the body 3 and the body 1. The transverse projection 393 forms a hook 394 in this example.

In the illustrated embodiment, the assembly element 39 is here attached to the gliding body 3 by means of two screws 392, 396. The center distance between the screws 392 and 396 is equal to at least half of the width of the gliding body 3 so as to limit the bending deformation of the assembly element 39 about a longitudinal axis of the gliding apparatus.

The screw 392 is positioned in the area of an end 395 of the assembly element 39. This screw 392 has a wide head so as to form an edge 3921 projecting from the contour of the plate 391.

In this example, the assembly element 49 is identical to the assembly element 39. Therefore, it includes a substantially planar plate 491. The plate 491 has a portion 499 in contact with the upper surface 47 of the gliding body 4, and arranged above the upper surface 47. The longitudinal projection 497 forms an extension of the plate 491 extending longitudinally beyond the longitudinal edge 41 of the gliding body 4. The longitudinal projection 497 forms a hook 498 designed to cooperate with an end 395 of the assembly element 39 when the intermediate gliding body 5 is assembled. The hook and the end of the assembly element are arranged so as to limit the relative spacing between the gliding bodies 3 and 4 when the hook 498 cooperates with the assembly element 39.

The assembly element 49 also comprises a transverse projection 493 beyond the gliding body 4. The transverse projection 493 forms an extension of the plate 491. It extends laterally beyond one side of the gliding body 4. The transverse projection 493 forms a positioning element designed to cover a portion of the upper surface 27 of the gliding body 2 in the configuration of FIG. 2. The transverse projection 493 thus makes it possible to limit a relative vertical movement between the body 4 and the body 2. The transverse projection 493 forms a hook 498 in this example.

The assembly element 49 here is attached to the gliding body 4 by means of two screws 492, 496. These screws 492 and 496 are transversely spaced by at least half of the width of the gliding body 4, so as to limit the bending deformation of the assembly element 49 about a longitudinal axis.

The screw 492 is positioned in the area of an end 495 of the assembly element 49. This screw 492 has a wide head so as to form an edge 4921 projecting from the contour of the plate 491.

Due to this dimensioning, the edges 3921 and 4921 of the screws 392 and 492 ensure vertical retention of the hooks 398, 498 when they cooperate with the assembly element 49, 39. The hooks 398, 498 are thus sandwiched between an edge 3921, 4921 and the upper surface 37, 47 of the gliding bodies 3, 4.

The assembly elements 39 and 49 are longitudinally affixed to one another, with the hook of the longitudinal projection 397 retaining the end 495 of the plate 491, on the one hand, and the hook 498 of the longitudinal projection 497 retaining the end 395 of the plate 391, on the other hand. The assembly elements 39 and 49 are easily affixed by nesting.

To assemble the two gliding bodies 3 and 4 to form the intermediate gliding body 5, it suffices to position the longitudinal edges 31, 41 against one another, the two gliding bodies 3 and 4 being misaligned, or offset, so that the longitudinal projections 397, 497 do not hinder bringing closer together the gliding bodies. Then, the gliding body 3 is translated laterally with respect to the other gliding body 4 so that both are substantially aligned along the same longitudinal axis. This configuration is achieved when the end 395 abuts against the hook 497 and, simultaneously, when the end 495 abuts against the hook 397. The intermediate gliding body 5 is then assembled. The intermediate gliding body 5 has a self-retention ability that makes it easy to handle. The two gliding bodies 3 and 4 are affixed longitudinally, vertically, and along a transverse direction. The two gliding bodies are properly retained independently due to the assembly elements 39 and 49. This assembly also enables good continuity between the gliding surface of the gliding body 3 and that of the gliding body 4.

In an alternative embodiment, a lock may be provided for blocking the still free transverse displacement. This lock may be removable. It can be connected to a gliding body. The lock makes it possible to maintain the first assembly element 49 and the second assembly element 39 in engagement with one another. For example, it may be a fastener connecting the plates 391, 491.

Advantageously, the two assembly elements 39, 49 each have an inclined edge, opposite one another, during assembly. These two inclined edges are designed to cooperate with one another during assembly so as to exert a force on the gliding bodies, which tends to bring them closer together along a longitudinal direction.

Figure 13:
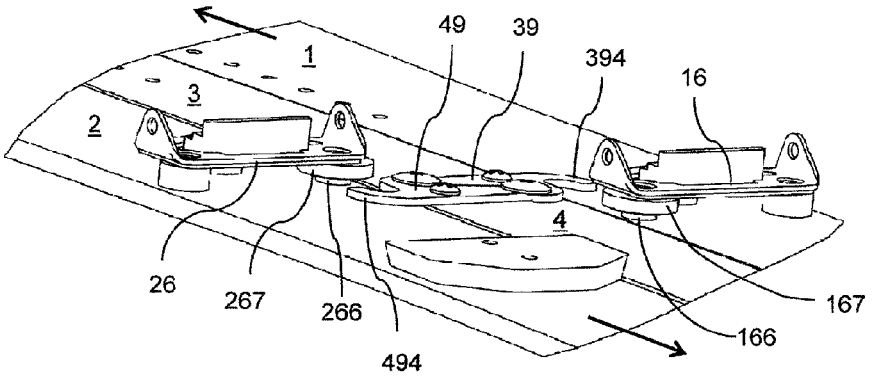
FIG. 13 is a perspective detailed view of a gliding apparatus according to the second embodiment, during an intermediate step of affixing its gliding bodies to one another.

The affixing of the intermediate gliding body 5 to the gliding bodies 1 and 2 can be carried out analogously to the first embodiment, as shown in FIG. 13. In this case, the first transverse projection 483A is replaced by a transverse projection 393 of the assembly element 39 designed to cover a portion of the upper surface 17 of the gliding body 1 in the configuration of FIG. 2. The transverse projection 393 forms a hook 398. Similarly, the second transverse projection 483B is replaced by a transverse projection 493 of the assembly element 49 designed to cover a portion of the upper surface 27 of the gliding body 2 in the configuration of FIG. 2. The transverse projection 493 forms a hook 498. In the first mode embodiment, the transverse projections 483A and 483B formed the extension of a same assembly element 48. Here, it is not the case; each of the transverse projections 393 and 493 is the extension of a specific assembly element 39, 49. The affixation between the gliding bodies 1 and 2 is therefore not directly obtained by the same assembly element of this affixation device. For this embodiment, the transverse retention is less efficient than in the first embodiment.

Figure 14:
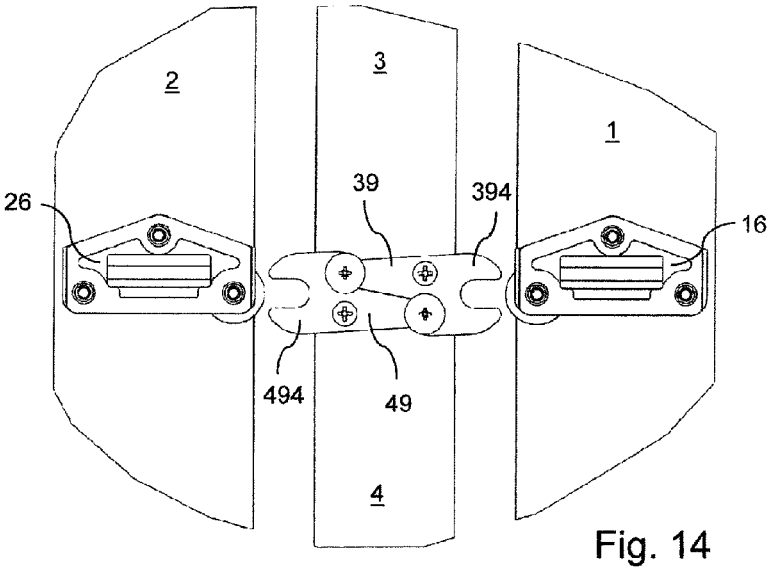
FIG. 14 is a top view of an alternative gliding apparatus during affixation of its gliding bodies.

FIG. 14 illustrates an alternative solution for longitudinally and vertically affixing the intermediate gliding body 5 to the gliding bodies 1 and 2. This solution does not provide transverse affixation that must be achieved by other means, such as the assembly elements 14, 35, 24, 15, 46, 25 and/or the hooks 18, 28, 34, 24 described above, for example.

In this variation:

the hook 398 forms a fork 394 and is configured to be affixed to the abutment 165 by a transverse sliding movement instead of a longitudinal sliding movement. The fork 394 then limits the longitudinal movements between the bodies 3 and the body 1 in both directions; and the hook 498 forms a fork 494 and is configured to be affixed to the abutment 265 by a transverse sliding movement. The fork 494 then limits the longitudinal movements between the body 4 and the body 2 in both directions.

The affixation of the intermediate gliding body 5 to the gliding bodies 1 and 2 is then carried out by transverse nesting.

The gliding bodies 1, 2, 3, 4 advantageously have keying structures to facilitate their affixation in order to obtain the configuration of a snowboard. The left edge of the gliding body 1 may, for example, have the same color as the right edge of the gliding bodies 3 and 4. The right edge of the gliding body 2 may, for example, have the same color as the left edge of the gliding bodies 3 and 4, and a different color from that of the left edge of the gliding body 1. The risk of affixing the gliding bodies 3 and 4 to the gliding bodies 1 and 2 in the wrong direction may thus be avoided.

In the previous embodiments, the assembly elements are plates or screws. Other constructions can be implemented.

For example, the affixation device is obtained by a specific interface forming a longitudinal edge 31, 41 of a gliding body 3 and 4. For example, a longitudinal end of a gliding body 3 forms the male portion, and the longitudinal end of a gliding body 4 forms the opposite female part. An example of interface may be a dovetail-type configuration.

The assembly elements are not necessarily attached to the upper surface of a gliding body. They can be attached to a side, for example.

To ensure transverse retention of the gliding bodies to one another, the affixation device comprises retaining elements. In these illustrations, these retaining elements are transverse projections. Other solutions are also embraced by the invention. This retaining element cooperates with a retaining element. In the examples, the retaining element takes the form of an abutment. Other variations are possible.

In the illustrated embodiments, the gliding bodies 3 and 4 are separable in the ski touring practice configuration. However, it is also within the scope of the invention to affix the gliding body 3 to the gliding body 4 longitudinally by means of a pivotal connection about a transverse axis, so that the gliding bodies 3 and 4 can be folded onto one another.

The invention is not limited to these embodiments. It is possible to combine these embodiments.

The invention also extends to all of the embodiments covered by the annexed claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A gliding apparatus comprising:

four gliding bodies comprising a first gliding body, a second gliding body, a third gliding body, and a fourth gliding body configured to be selectively affixed together to form an assembled configuration or separated from one another to assume a disassembled configuration;

in the assembled configuration:

the first and second gliding bodies form opposite lateral portions of the gliding apparatus;

the third and fourth gliding bodies form an intermediate gliding body defining a median portion of the gliding apparatus;

each of the third and fourth gliding bodies having a respective length less than a length of the intermediate gliding body, the intermediate gliding body being arranged transversely between the first and second gliding bodies;

an affixation device comprising:

a first assembly element affixed to the fourth gliding body;

a second assembly element affixed to the third gliding body and configured to be engaged with the first assembly element to affix together the third and fourth gliding bodies longitudinally to form the intermediate gliding body;

the first assembly element comprising at least a first longitudinal projection, projecting from the fourth gliding body, configured to cover a portion of an upper surface of the third gliding body;

the first longitudinal projection of the first assembly element being configured to be engaged with the second assembly element so as to limit a relative spacing between the third and fourth gliding bodies along a longitudinal axis;

the third and fourth gliding bodies having respective structures configured to facilitate disconnection of the third and fourth gliding bodies by a relative movement between the third and fourth gliding bodies, wherein the relative movement comprises a relative transverse translation between the third and fourth gliding bodies.

2. A gliding apparatus according to claim 1, wherein:

the second assembly element comprises a screw, the screw including a head extending radially of a longitudinal axis of the screw sufficiently to extend over a portion of the first assembly element.

3. A gliding apparatus according to claim 1, further comprising:

a lock configured to maintain the first assembly element and the second assembly element in engagement with one another.

4. A gliding apparatus according to claim 1, wherein:

the four gliding bodies have keying structure facilitating affixing together the four gliding bodies in the assembled configuration, the assembled configuration being a configuration of a snowboard.

5. A gliding apparatus according to claim 1, wherein:

one of the first and second assembly elements is attached to the third or fourth gliding body by at least two screws;

a center distance between the two screws being equal to at least one half of a transverse width of the third or fourth gliding body.

6. A gliding apparatus comprising:

four gliding bodies comprising a first gliding body, a second gliding body, a third gliding body, and a fourth gliding body configured to be selectively affixed together to form an assembled configuration or separated from one another to assume a disassembled configuration;

in the assembled configuration:

the first and second gliding bodies form opposite lateral portions of the gliding apparatus;

the third and fourth gliding bodies form an intermediate gliding body defining a median portion of the gliding apparatus;

each of the third and fourth gliding bodies having a respective length less than a length of the intermediate gliding body, the intermediate gliding body being arranged transversely between the first and second gliding bodies;

an affixation device comprising:

a first assembly element affixed to the fourth gliding body;

a second assembly element affixed to the third gliding body and configured to be engaged with the first assembly element to affix together the third and fourth gliding bodies longitudinally to form the intermediate gliding body;

the first assembly element comprising at least a first longitudinal projection, projecting from the fourth gliding body, configured to cover a portion of an upper surface of the third gliding body;

the first longitudinal projection of the first assembly element being configured to be engaged with the second assembly element so as to limit a relative spacing between the third and fourth gliding bodies along a longitudinal axis;

at least one of the first and second assembly elements comprising a transverse projection projecting from the intermediate gliding body and configured to cover a portion of an upper surface of the first or second gliding body.

7. A gliding apparatus according to claim 6, wherein:

the third and fourth gliding bodies have respective structures configured to facilitate disconnection of the third and fourth gliding bodies by a relative movement between the third and fourth gliding bodies.

8. A gliding apparatus comprising:

four gliding bodies comprising a first gliding body, a second gliding body, a third gliding body, and a fourth gliding body configured to be selectively affixed together to form an assembled configuration or separated from one another to assume a disassembled configuration;

in the assembled configuration:

the first and second gliding bodies form opposite lateral portions of the gliding apparatus;

the third and fourth gliding bodies form an intermediate gliding body defining a median portion of the gliding apparatus;

each of the third and fourth gliding bodies having a respective length less than a length of the intermediate gliding body, the intermediate gliding body being arranged transversely between the first and second gliding bodies;

an affixation device comprising:

a first assembly element affixed to the fourth gliding body;

a second assembly element affixed to the third gliding body and configured to be engaged with the first assembly element to affix together the third and fourth gliding bodies longitudinally to form the intermediate gliding body;

the first assembly element comprising at least a first longitudinal projection, projecting from the fourth gliding body, configured to cover a portion of an upper surface of the third gliding body;

the first longitudinal projection of the first assembly element being configured to be engaged with the second assembly element so as to limit a relative spacing between the third and fourth gliding bodies along a longitudinal axis;

the first assembly element comprising a first retaining element cooperating with a first retaining element of the second gliding body so as to limit a relative transverse movement between the second gliding body and the intermediate gliding body when the gliding apparatus is in the assembled configuration.

9. A gliding apparatus according to claim 8, wherein:

the first assembly element comprises a second retaining element cooperating with a second retaining element of the first gliding body so as to limit a relative transverse movement between the first gliding body and the intermediate gliding body when the gliding apparatus is in the assembled configuration.

10. A gliding apparatus according to claim 8, wherein:

the second assembly element comprises a second retaining element cooperating with a second retaining element of the first gliding body so as to limit a relative transverse movement between the first gliding body and the intermediate gliding body when the gliding apparatus is in the assembled configuration.

11. A gliding apparatus according to claim 10, wherein:

at least one of the first and second retaining elements of at least one of the first and second assembly elements is a transverse projection projecting from the intermediate gliding body and configured to cover a portion of an upper surface of the first or second gliding body; and at least one of the first and second retaining elements of at least one of the first and second gliding bodies is an abutment projecting perpendicularly from an upper surface of the at least one of the first and second retaining elements.

12. A gliding apparatus according to claim 11, wherein:

the transverse projection is configured to be engaged with the abutment so as to limit a relative longitudinal movement between the first or second gliding body and the intermediate gliding body, in at least one direction, when the gliding apparatus is in the assembled configuration.

13. A gliding apparatus according to claim 11, wherein:

the abutment comprises a shoulder projecting vertically above the upper surface of the first or second gliding body, the transverse projection being held between the upper surface of the first or second gliding body and the shoulder for limiting a relative movement between the first or second gliding body and the intermediate gliding body along a direction perpendicular to the upper surface.

14. A gliding apparatus according to claim 11, wherein:

the first or second body comprises a base of a safety binding configured to be affixed to a boot of a user, the base being fixed to the abutment and positioned above the abutment.

15. A gliding apparatus according to claim 8, wherein:

the third and fourth gliding bodies have respective structures configured to facilitate disconnection of the third and fourth gliding bodies by a relative movement between the third and fourth gliding bodies.

* * * * *